US006626769B1

(12) United States Patent
Lin

(10) Patent No.: US 6,626,769 B1
(45) Date of Patent: Sep. 30, 2003

(54) WOOD CLUB HEAD

(75) Inventor: Chon-Chen Lin, Kaohsiung (TW)

(73) Assignee: O-TA Precision Casting Co., Ltd. (TW)

( * ) Notice: Subject to any disclaimer, the term of this patent is extended or adjusted under 35 U.S.C. 154(b) by 0 days.

(21) Appl. No.: 10/121,584

(22) Filed: Apr. 15, 2002

(51) Int. Cl.[7] ..... A63B 53/04
(52) U.S. Cl. ..... 473/345; 473/349
(58) Field of Search ..... 473/324, 345, 473/346, 349, 350, 290, 291

(56) References Cited

U.S. PATENT DOCUMENTS 4,432,549 A * 2/1984 Zebelean
4,438,931 A * 3/1984 Motomiya
5,024,437 A * 6/1991 Anderson
5,232,224 A * 8/1993 Zeider
5,346,217 A * 9/1994 Tsuchiya
5,997,415 A * 12/1999 Wood
6,071,200 A * 6/2000 Song
6,238,300 B1 * 5/2001 Igarashi
6,334,817 B1 * 1/2002 Ezawa
6,364,788 B1 * 4/2002 Helmstetter
6,458,043 B1 * 10/2002 McCabe

* cited by examiner

*Primary Examiner*—Sebastiano Passaniti
(74) *Attorney, Agent, or Firm*—Bacon & Thomas, PLLC

(57) ABSTRACT

A wood club head includes a hollow base, a top panel and a striking face. The base is integrally formed by casting and has a top opening and a front opening defined therein. A flange extends inwardly from a periphery defining the top opening. The top panel and the striking face are integrally formed together by forging. The top panel is welded onto the base and along an edge of the flange to cover the top opening. The striking face is welded onto the base to cover the front opening. Therefore, the present invention utilizes the advantages of casting and forging to create a high performance club head. Moreover, the welding between the top panel and the base is performed on the flange which extends substantially away from corner edges of the club head to prevent damaging of rigidity of the wood club head.

2 Claims, 3 Drawing Sheets

WOOD CLUB HEAD

BACKGROUND OF THE INVENTION

1. Field of the Invention

The present invention relates the field of golf clubs, and more particularly to a wood club head.

2. Description of Related Art

Three types of golf clubs are commonly used in a game of golf—a putter, an iron, and a wood club. Each type of club is designed to correspond to a certain field condition and a particular distance.

The wood club, originally having a wooden club head, is designed to hit a ball far. Recently it has become popular for the wood club heads to be made of metal or alloy to provide high rigidity.

With reference to FIG. 3 a conventional wood club head is shown and composed of a base (70), a top panel (80) and a striking face (90), wherein these three components are typically produced by way of forging. The base (70) has a top opening (72) and a front opening (74) defined therein. The top panel (80) and the striking face (90) are then welded onto the base (70) and respectively cover the top opening (72) and the front opening (74).

However, the conventional wood club has the following disadvantages:

1. The base (70) is made by forging, and cannot be integrally formed as by casting in a foundry. Therefore, due to the nature of forging, variation in shape of the base (70) is limited. Also, the wood club base (70) made by forging is expensive due to the number of operations required to get the finished product.

2. The top panel (80) is welded onto the base (70) and welding inevitably impairs rigidity of the wood club. In particular, when the welding is preformed along a corner edge of the wood club as done in the conventional wood club, damage to the rigidity is even greater.

3. The top panel (80) and the striking face (90) are welded together. In accordance with the above explanation, welding again impairs rigidity of the striking face (90) and thus considerably affects the performance of the wood club.

Therefore, the present invention intends to provide an improved wood club head to mitigate and/or obviate the aforementioned problems.

SUMMARY OF THE INVENTION

An objective of the present invention is to provide a wood club head, wherein a base of the wood club head is integrally formed so as to create various configurations of the base. Moreover, the cost related to manufacturing the wood club head can be reduced if compared with a conventional wood club head.

Another objective of the present invention is to provide a wood club head such that a top panel is welded substantially away from corner edges of the wood club head so as to minimize impairing rigidity of the wood club head due to welding.

Another objective of the present invention is to provide a wood club head having a top panel integrally formed with a striking face so that fineness and rigidity of the top panel and the striking face are maintained.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
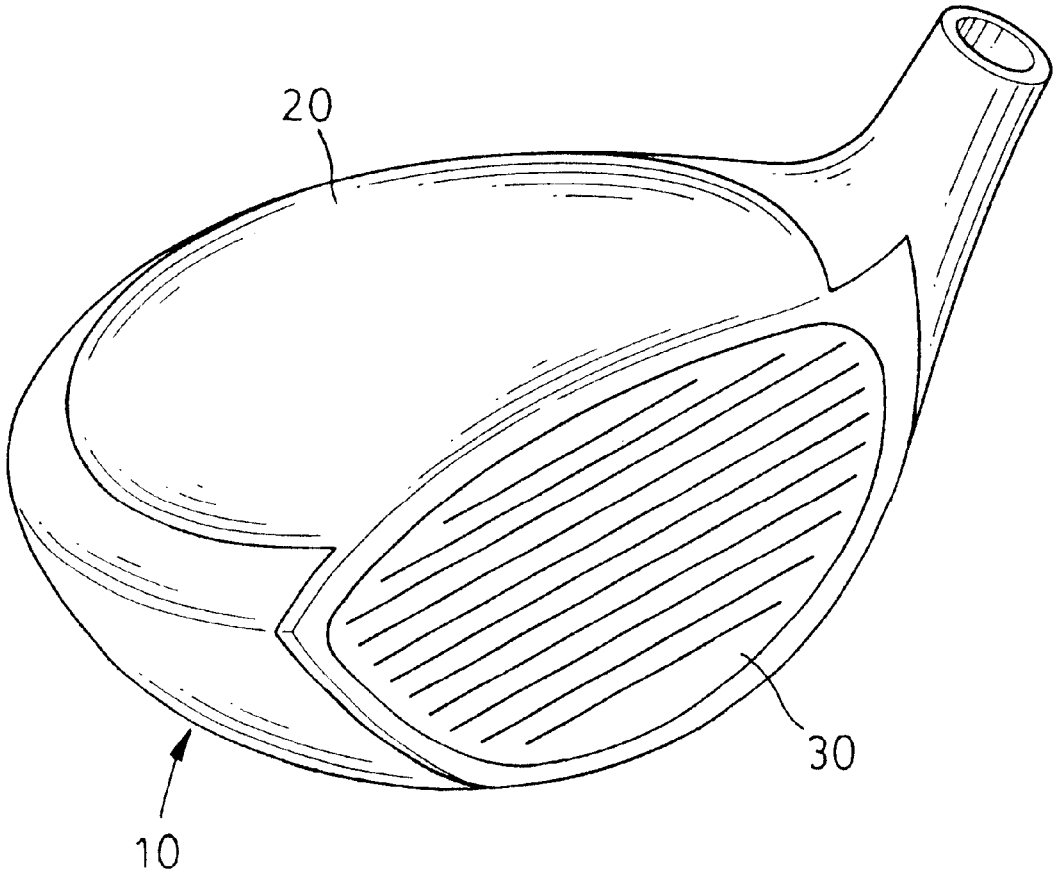
FIG. 1 is a perspective view of a wood club head in accordance with the present invention.
Figure 2:
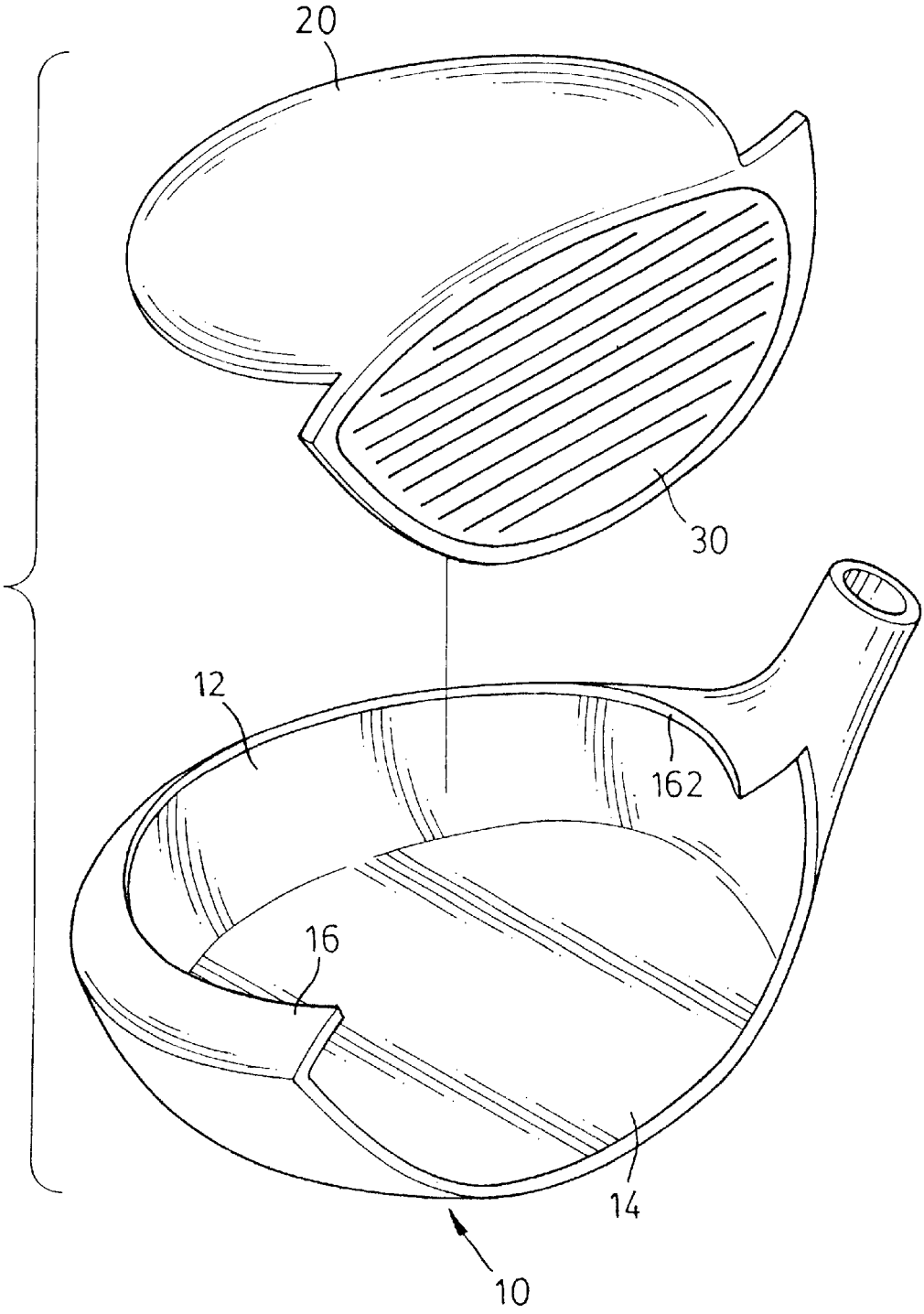
FIG. 2 is an exploded perspective view of the wood club head.
Figure 3:
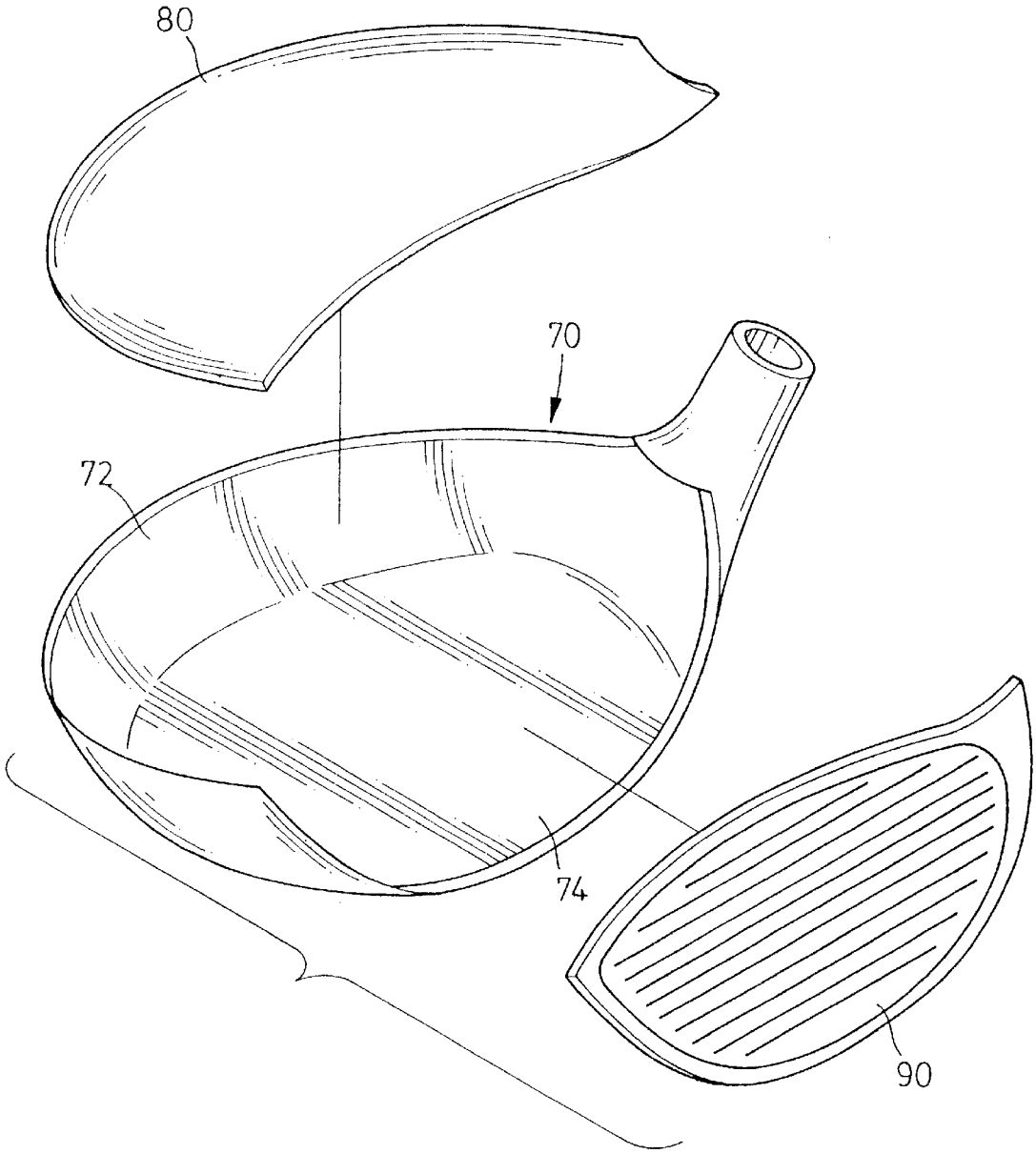
FIG.3 PRIOR ART
FIG. 3 is a conventional wood club head.

With reference to FIGS. 1 and 2, a wood club head in accordance with the present invention includes a hollow base (10), a top panel (20) and a striking face (30).

The base (10) is integrally formed by casting to have a preferred thickness no less than 1.0 mm, and has a top opening (12) and a front opening (14) defined to communicate with the top opening (12). A flange (16) extends inwardly along a top periphery defining the top opening (12).

The top panel (20) and the striking face (30) are integrally formed together by forging, wherein the top panel (20) has a preferred thickness of between 1 mm to 1.5 mm and the striking face (30) has a preferred thickness of between 2.4 mm to 3 mm. The top panel (20) is welded onto the base (10) to cover the top opening (12) while the striking face (30) is welded onto the base (10) to cover the front opening (14). It is noted that the welding between the top panel (20) and the base (10) is performed along an edge (162) of the flange (16).

Due to the nature of casting, shapes of the base (10) can be produced in a lot of variations in order to meet different requirements of golfers to hit a golf ball appropriate distances and directions. Moreover, the appearance of the club head can thus be attractively designed for commercial purposes. In addition, it is cheaper to cast than forge the base (10).

Due to the nature of forging, the rigidities of the top panel (20) and the striking face (30) are high. Therefore, the thicknesses of the top panel (20) and the striking face (30) can be made thinner and lighter if compared with those made by casting. Consequently, the volume of the club head can be larger than 280 $cm^3$ yet still satisfy the weight standard of the club head.

It is noted that the welding between the top panel (20) and the base (10) is performed along the edge (162) which extends substantially away from corner edges of the base (10) to prevent damaging rigidity of the wood club head.

It is also noted that the top panel (20) and the striking face (30) are integrally formed without welding therebetween, thereby minimizing welding damages which would otherwise impair the rigidity and fineness of the finished wood club head.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wood club head comprising:

a hollow base integrally formed by casting, and having a top opening, a front opening defined to communicate with the top opening and a flange extending inwardly along a top periphery defining the top opening and an outer edge of the flange connects to an outer edge of the front opening so that the top opening and the front opening are in direct communication with one another;

a top panel and a striking face are integrally formed together, wherein the top panel is welded onto the hollow base along the outer edge of the flange to cover the top opening, and the striking face is welded onto the hollow base along the outer edge of the front opening to cover the front opening; and wherein a thickness of the hollow base is not less than 1 mm, a thickness of the top panel is between 1 mm and 1.5 mm, and a thickness of the striking face is between 2.4 mm and 3 mm.

2. The wood club head as claimed in claim 1, wherein the top panel and the striking face are integrally formed together by forging a single metal piece.

* * * * *